United States Patent [19]

Giordano

[11] Patent Number: 4,536,022

[45] Date of Patent: Aug. 20, 1985

[54] PARTIALLY SECURE LATCH AND LOCK DEVICE

[76] Inventor: Joseph F. Giordano, 8028 Oleander, Fontana, Calif. 92335

[21] Appl. No.: 508,009

[22] Filed: Jun. 27, 1983

[51] Int. Cl.[3] ..... E05C 3/14

[52] U.S. Cl. ..... 292/228; 292/207

[58] Field of Search ..... 292/333, 106, 128, 207, 292/228, 129, 229, 179, DIG. 13

[56] References Cited

U.S. PATENT DOCUMENTS

| | | | |
|---|---|---|---|
| 874,633 | 12/1907 | Stevens | 292/228 |
| 1,642,612 | 9/1927 | Haarberg | 292/128 |
| 3,087,749 | 4/1963 | Capton | 292/106 X |
| 3,241,872 | 3/1966 | Moore | 292/207 X |
| 3,591,219 | 7/1971 | Graziosi | 292/207 |
| 4,111,475 | 9/1978 | McCormick et al. | 292/207 X |
| 4,451,072 | 5/1984 | Petty, Sr. | 292/128 |
| 4,478,444 | 10/1984 | Kurz et al. | 292/333 |

FOREIGN PATENT DOCUMENTS

| | | | |
|---|---|---|---|
| 469176 | 7/1937 | United Kingdom | 292/106 |

*Primary Examiner*—Gary L. Smith
*Assistant Examiner*—Thomas J. Dubnicka
*Attorney, Agent, or Firm*—Harvey S. Hertz

[57] ABSTRACT

A gate latch device shown for swinging and sliding gates. In the swinging gate embodiment, a latch bar rides over a strike plate until a notch in the latch bar is engaged. A pin is simultaneously depressed by contact with the strike plate which releases a latching pin or bolt to immobilize the latch bar until a manual release is effected from a visually non-obvious location. For a sliding gate, concentric mutually slideable tubular members are provided, one mounted to the sliding gate and the other carrying an articulated jaw which engages a pin or bolt on a fixed structure on a fixed structure to which the gate is closed. A combination lock is adapted to lock the tubular members together.

4 Claims, 9 Drawing Figures

FIG. 1
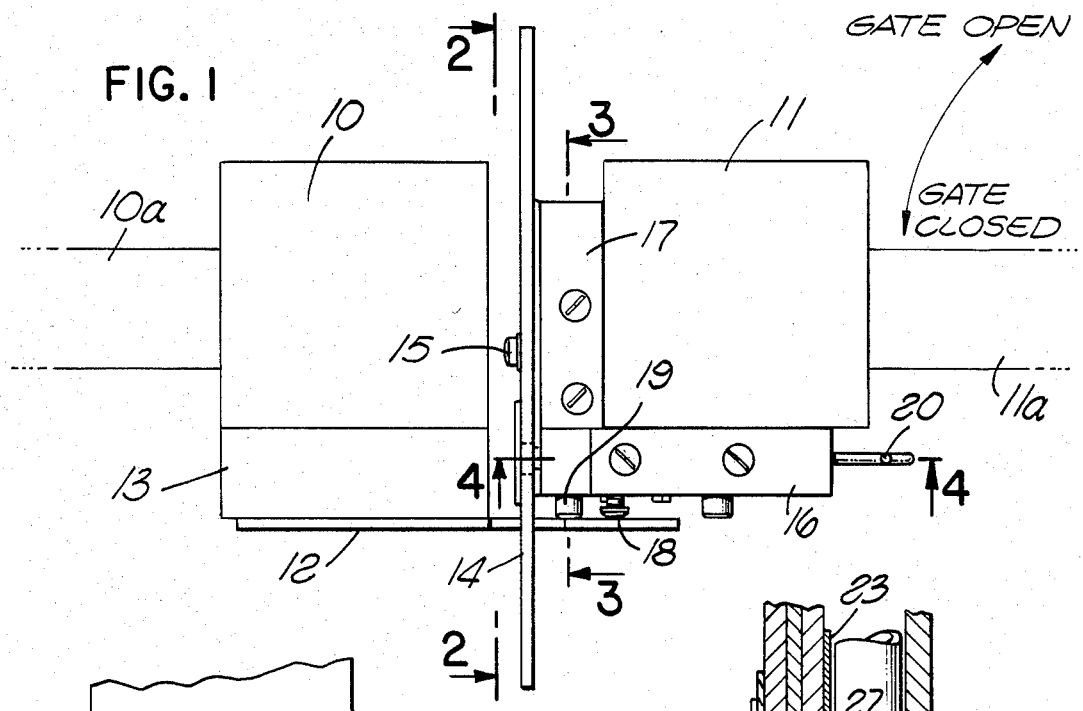
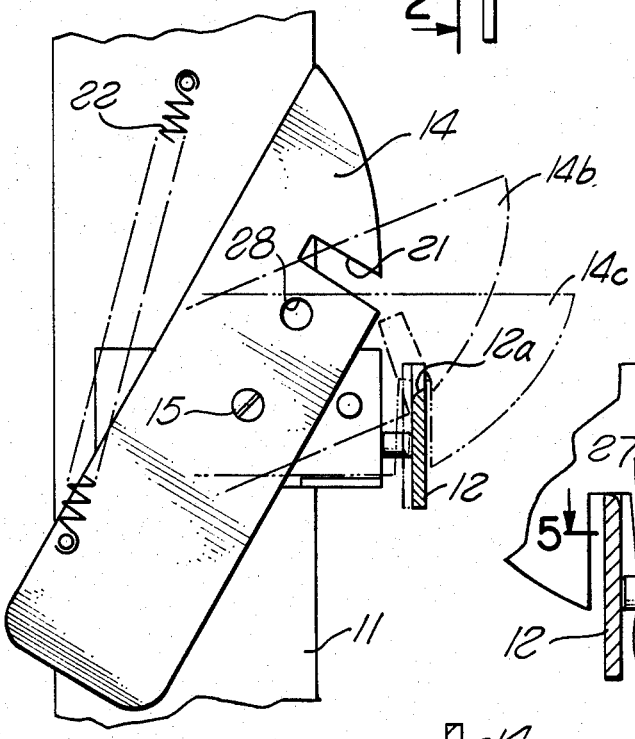
FIG. 2
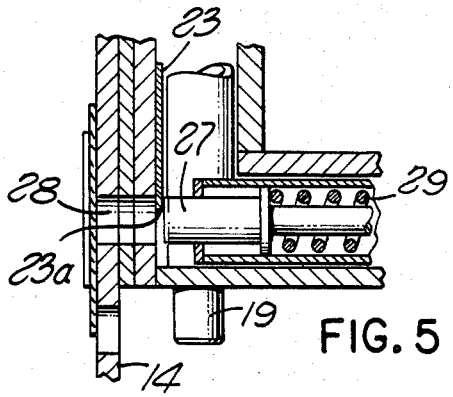
FIG. 5
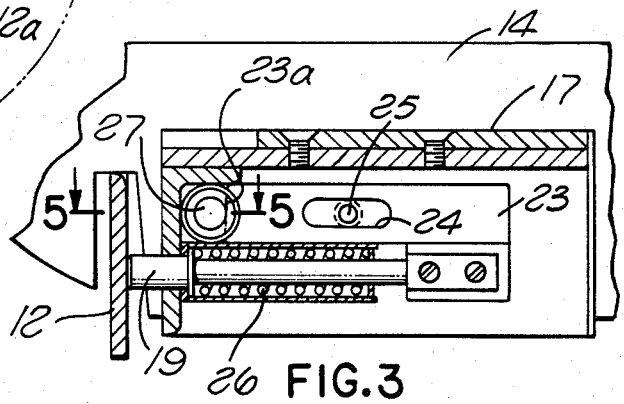
FIG. 3
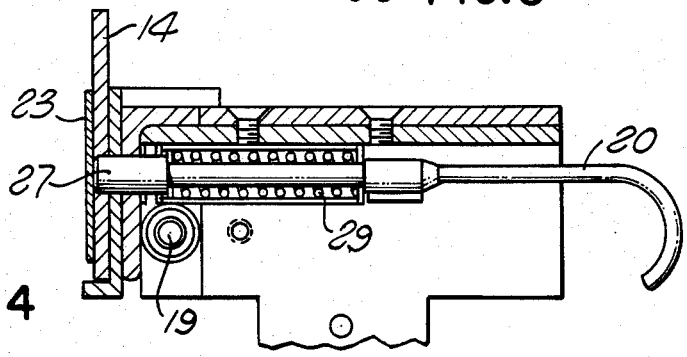
FIG. 4

PARTIALLY SECURE LATCH AND LOCK DEVICE

BACKGROUND OF THE INVENTION

1. Field of the Invention

The invention relates to latching and locking devices for gates and the like adapted for at least partial security.

2. Description of the Prior Art

In the prior art, locks and latches of many descriptions have evolved for use on doors, gates and the like. The degree of security justified in the design and application of such locks and latches is determined by the possible consequences of unauthorized or surreptitious entry.

A gate, for passage through a fence, for example, ordinarily does not require a high order or entry security because an intruder may be able to simply scale the fence or gate or otherwise breach the barrier. An important degree of security against the casual intruder is often obtainable if only the latch operator is unobvious.

Typically of the state of the relevant prior art in latches and locks generally are U.S. Pat. Nos. 1,489,675; 3,206,954; 2,700,292; 4,179,143; 1,187,756; 2,671,683; 2,466,855; 3,692,342 and 3,709,538.

U.S. Pat. No. 1,489,675 shows the classical and ubiquitous spring door latch (key opened or locked).

U.S. Pat. No. 3,206,954 describes a variation of the classical spring latch door lock in which operation is by normal force (pull or push depending upon which door side the operator is positioned) rather than by door knob rotation.

U.S. Pat. No. 2,700,292 depicts another form of knob or handle operated, key-lockable, door latch assembly in which the latch member rotates in a plane parallel to the plane of the door and rides up, over and behind a sawtooth strike plate on a door frame in lieu of the usual horizontally translated latch member.

U.S. Pat. No. 4,179,143 shows a simple "barrel bolt" type of translating latch member with means for latching in the extended direction and quickly releasing for spring induced withdrawal.

A barn door spring latch mechanism without keying or other locking features in shown in U.S. Pat. No. 1,187,756. No security features are included.

U.S. Pat. No. 2,466,855 is a compressed-air operated lock for freight car doors intended for high order security against surreptitious entry by persons not equipped with the required compressed-air apparatus.

U.S. Pat. No. 3,692,342 is entitled "Container, Post Locking Member" but does not appear to be an operative latch or lock device. Rather, it is an assembly apparatus for a knock-down container on a pallet base structure such as used in commercial shipping U.S. Pat. No. 3,709,538 shows a device for securing a cover (hinged or otherwise) on a chest or receptacle with easy release. No security features are disclosed.

A gate latch constituting somewhat more pertinent prior art vis-a-vis the invention is disclosed in U.S. Pat. No. 2,671,683. No security features are contemplated and the operation is immediately obvious, even to a casual observer.

None of the aforementioned prior art disclosures address the requirement for any operatively non-obvious gate latch device also capable of being simply locked for additional security.

The manner in which the invention deals with the inadequacies of the prior art to provide a relatively simple, but greatly improved, lockable latch device, for a gate or the like, will be evident as this description proceeds.

SUMMARY OF THE INVENTION

In consideration of the aforementioned state of the prior art, it may be said to be the general object of the invention to provide a simple and inexpensive gate-type latch with a non-obvious operating member and with the capability of including a simple integral combination type lock for greater security.

The invention is described in two embodiments, a first of which applies to a hinged, swinging gate. The second embodiment applies to a sliding gate which opens and closes by sliding substantially in the plane of the associated fence or barrier opening.

Both embodiments provide a gate latch with non-obvious operating means adapted for installation of an an optional locking mechanism. For a hinged, swinging gate, a horizontally extending strike plate or edge in a vertical plane is engaged by a latch bar from the structure of the gate. The latch bar engages from a right angle position, is pivoted and has a chamfered end permitting it to pivot upward and ride over the strike plate until a slot in the latch bar engages the strike plate permitting the latch bar to drop back to a horizontal position. A spring loaded tripper button on the housing of the gate mounted latch mechanism acts to release a locking bolt (pin) into a hole in the latch bar. Release and reset of the locking bolt is effected by a reset lever which is located so as to be at least partially obscured by the gate structure.

For a sliding gate, a pair of concentric tubular members are employed, one anchored on one end to the sliding gate and the other slideably fit over the anchored tubular member. A pin or bolt mounted on the fixed structure, adjacent to an end of the sliding gate when it is closed, is engaged by a slot in a jaw on the free end of the slideable tubular member and bears against a pivoted jaw portion erecting a tongue which slips into the tubular members as the gate is completely closed.

Both embodiments are adapted to the inclusion of an integral lock, such as a combination lock which extends a locking pin (the the locked position) into a part of the mechanism to prevent release of the latching mechanism until the lock is operated to withdraw the locking pin.

The detailed structure and operation of the embodiments will be understood as this specification continues.

BRIEF DESCRIPTION OF THE DRAWINGS

FIG. 1 is a plan view of the apparatus of the invention applied to a swinging gate;

FIG. 2 is a sectional view of the latching mechanism of the embodiment of FIG. 1, taken along line 2—2 as indicated on FIG. 1;

FIG. 3 is a sectional view of portions of the mechanism, taken along line 3—3 as indicated on FIG. 1;

FIG. 4 is an additional sectional view taken along line 4—4 as indicated in FIG. 1;

FIG. 5 is an orthogonal section taken along line 5—5 as indicated in FIG. 3;

DETAILED DESCRIPTION

Figure 6:
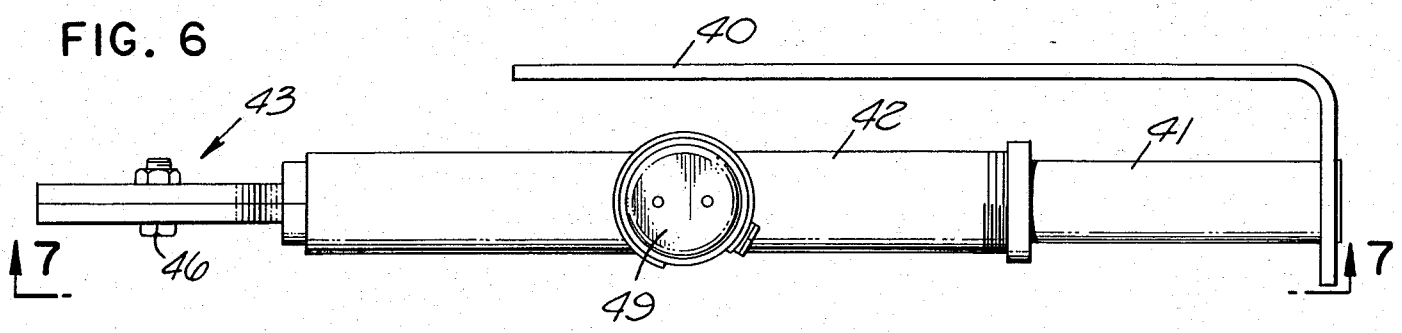
FIG. 6 is an overall plan view of an embodiment of the invention adapted for a sliding gate.

Referring now to FIG. 1, a plan view is presented in which a typical post 10 is to be understood to be affixed to the stationary structure of a fence or other barrier and post 11 is the adjacent structural member of the swinging gate. The fence or barrier continuing from post 10 is represented as structure 10*a*, and the further structure of the gate extending toward a hinge position is represented as structure 11*a*.

A strike plate 12 is mounted on edge (substantially in a vertical plane) and projects over the gate opening as will be seen from FIG. 1. A spacer 13 is a convenience only in the illustrative arrangement of FIG. 1 and would not always be necessary. For example, the post 10 may be larger than post 11 in a practical situation making the same relative arrangement of the parts of the mechanism possible without spacer 13.

A latch mechanism housing comprising 16 and 17 is attached to the post 11, by screws for example. A latch bar 14 is pivoted about mounting bolt 15 and as the gate is closed it rides up over the strike plate 12. FIG. 2 shows this from a side view as indicated on FIG. 1, 14*b* and 14*c* being successive positions of bar 14 as its rounded edge first rides up over plate 12 (position 14*b*) and then drops into position 14C with a notch 21 engaging strike plate 12 as shown. A chamfer 12*a* on plate 12 facilitates this ride-up of latch bar 14 during gate closing. Actually, a spring 22 is desirable to urge latch bar 14 into position 14*c*, although a gravity arrangement could be employed, in which case latch bar 14 may be shortened (downward, at the left end as seen on FIG. 2) so that the pivot point 15 is near the free end of latch bar 14.

A bolt head 18 (FIG. 1) serves as a stop for the closure motion, however before stop 18 comes against strike plate 12, a catch activating pin 19 is depressed inwardly, the result being evident as the further sectional views (FIGS. 3, 4, and 5) are understood. FIG. 3 shows an axially slideable assembly 23 within housing 17. This assembly 23 is constrained by the length of a slot 24 in sliding assembly 23 vis-a-vis pin 25, this pin being affixed to the housing 17 internally. As pin 19 is pushed inward, assembly 23 translates to the right (as seen on FIG. 3) against the force of compression spring 26, and a window in the sliding plate of sliding assembly 23 is opened as edge 23*a* moves rightward (FIG. 3) allowing pin 27 to be driven into hole 28 in latch bar 14 by spring 29 (see also FIG. 5). This immobilizes latch bar 14 so that it cannot simply be lifted for opening of the gate. However, the pin 27 may be withdrawn by an operator by pulling release lever 20 rightward (as shown in FIGS. 1 and 4). The latch bar 14 may then be depressed against spring 22 at its free end to open the gate.

Of course, if latch bar 14 were shortened as previously suggested for gravity operation, a more convenient means of lifting it for gate opening would be necessary.

Once the gate is opened, however, slightly, spring 26 "closes the window" over pin 27 until pin 19 is again depressed by contact with strike plate 12 during the next closure.

Referring now to FIGS. 6 through 9, the sliding gate embodiment will be described. In FIG. 6 the mechanism is preferably mounted by means of a bracket 40 onto the sliding gate. Parts 41 and 42 are the inner and outer tubular members, part 42 being slideable over part 41.

Figure 7:
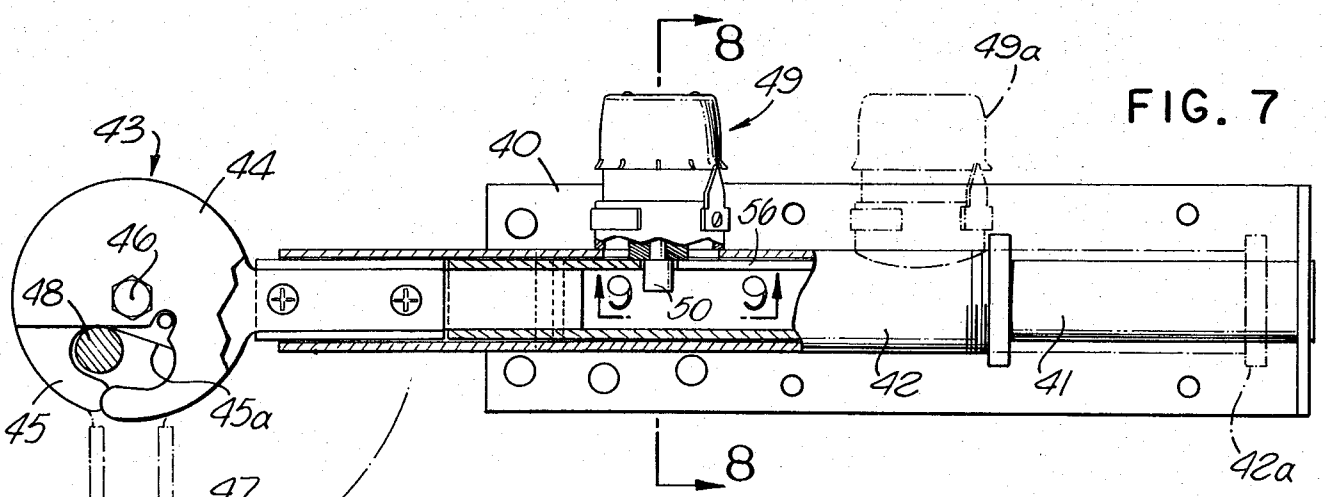
FIG. 7 is a partial cut-away view of the mechanism taken along line 7—7 as indicated in FIG. 6.
Figure 8:
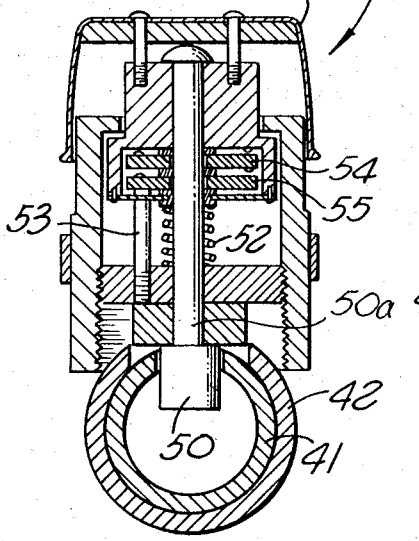
FIG. 8 is a sectional view of the combination lack taken along line 8—8 as indicated in FIG. 7.

In the "gate open" position, the conventional combination lock 49 is constructed such that a locking plunger 50 is pushed downward as the cap 51 is pushed downward (see FIGS. 7 and 8). Plunger 50 passes through and clears lateral holes in tubular members 41 and 42 which match when the assembly is in the "gate locked" position. In the "gate open" position, the combination lock assembly assumes position 49*a* as the tubular member 42 is slid to position 42*a*. When locked, the plunger 50 is engaged through those lateral holes in 41 and 42 and the cap 51 is "popped up" by spring 52.

A bolt or pin 48 will be understood to project from the fixed structure of the fence or barrier, comparable to the post 10 of FIG. 1. As the gate is translated toward closure, jaw member 44 (fixed to inner tubular member 41) slides over bolt or pin 48 as shown in FIG. 7, and bearing against 45*a*, causes rotatable jaw member 45 to rotate about 46 to effect closure of the jaw assembly 43. The tongue 47 is illustrated (in FIG. 7) in the "jaws open" position. However, tongue 47 is rotated upward to a position where tubular member 42 slides thereover, the "gate locked" position of pin 48 vis-a-vis closed jaws 44 and 45 being as shown in FIG. 7.

Figure 9:
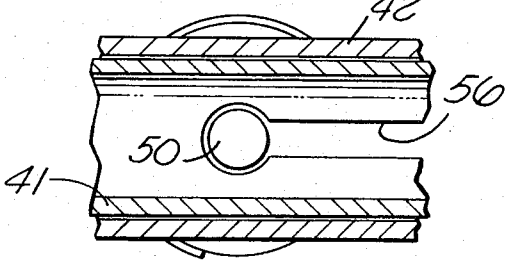
FIG. 9 is a further section taken along line 9—9 as indicated on FIG. 7.

The combination lock is, per se, conventional. The spindle 53 engages openings in the disks 54 and 55 during operation. FIG. 9 shows the engagement of pin 50 from inside the assembly as indicated on FIG. 7. In the unlocked position, the stem 50*a* does not prevent the outer tubular member 42 from sliding over the inner tubular member 41 but rather, the stem 50*a* lowers 50 into the interior of 41 and 50*a* clears within slot 56. The parts of FIG. 8 are illustrated in the locked position.

It will be realized that the lock assembly 49 could similarly be applied to the embodiment of FIGS. 1 through 5, either in a position to immobilize the latch bar 14 or to lock the release member 20 within housing 16.

Various modifications and variations within the spirit of the invention are obviously possible and accordingly, it is not intended that the invention should be regarded as limited to the structure and features shown ad described. The drawings and this description are intended to be typical and illustrative only.

What is claimed:

1. A latching device for a hinged swinging gate serving an opening between first and second substantially vertical, spaced, structural members, said gate being hinged to said first structural member, and said latching device being operative between said gate and said second structural member, comprising:

first means including a strike plate mounted on said second structural member, said strike plate having an upward edge;

second means including a latch bar associated with the structure of said gate, said latch bar being pivoted about a point of the structure of said gate and having a downward opening slot, said latch bar further including a shape causing it to rotate about said pivot point and ride upward over said strike plate and thereafter engaging said upward edge of said strike place in said slot as said gate is closed;

third means including a hole in said latch bar and a latching pin for immobilizing said latch bar when said pin projects into said hole;

and fourth means for inhibiting the projection of said pin, whereby said latch bar is free to rotate about said pivot point and to engage said strike plate as said gate is closed;

and fifth means including a spring arranged to project said pin into said hole, said fifth means including sixth means responsive to closure of said gate to release said fourth means thereby causing said spring to project said latching pin into said hole.

2. The latching device according to claim 1 in which said sixth means includes a trigger button and second spring means for spring biasing said trigger button outwardly toward said second structural member such that said trigger button is depressed when said second structural member is contacted as said gate is closed thereby effecting said release of said fourth means.

3. The latching device according to claim 2 comprising manual seventh means for withdrawing said latching pin from said latch bar hole for opening said gate, said trigger button being mechanically biased outward by said second spring to reset said inhibiting action of said fourth means as said gate is opened.

4. The latching device according to claim 3 in which said sixth means comprises a sliding member mechanically connected to said trigger button, said sliding member interposing between said latching pin and said latching bar through action of said second spring when said trigger button is free of said second structural member and said seventh means has been operated to withdraw said latching pin.

* * * * *